US012584663B2

(12) United States Patent
Lin et al.

(10) Patent No.: US 12,584,663 B2
(45) Date of Patent: Mar. 24, 2026

(54) DEVICE AND METHOD FOR MAGNETIC REFRIGERATION

(71) Applicants: Mitsubishi Electric Research Laboratories, Inc., Cambridge, MA (US); Mitsubishi Electric Corporation, Tokyo (JP)

(72) Inventors: Chungwei Lin, Cambridge, MA (US); Bingnan Wang, Cambridge, MA (US); William Vetterling, Cambridge, MA (US); Shun Tonooka, Tokyo (JP); Atsushi Ogasahara, Tokyo (JP)

(73) Assignees: Mitsubishi Electric Research Laboratories, Inc., Cambridge, MA (US); Mitsubishi Electric Corporation, Tokyo (JP)

( * ) Notice: Subject to any disclaimer, the term of this patent is extended or adjusted under 35 U.S.C. 154(b) by 413 days.

(21) Appl. No.: 18/068,544

(22) Filed: Dec. 20, 2022

(65) Prior Publication Data

US 2024/0200834 A1 Jun. 20, 2024

(51) Int. Cl.
*F25B 21/02* (2006.01)

(52) U.S. Cl.
CPC ..... *F25B 21/02* (2013.01); *F25B 2321/002* (2013.01)

(58) Field of Classification Search
CPC .... F25B 21/02; F25B 2321/022; F25B 21/00; Y02B 30/00
USPC ..... 62/31
See application file for complete search history.

(56) References Cited

U.S. PATENT DOCUMENTS 6,494,048 B1 * 12/2002 Ghoshal ..... H10N 10/853 62/3.2
2013/0319012 A1 * 12/2013 Kuo ..... F25B 21/00 62/3.1
2014/0290273 A1 * 10/2014 Benedict ..... F25B 21/00 62/3.1

(Continued)

FOREIGN PATENT DOCUMENTS

JP 2012151211 A * 8/2012

OTHER PUBLICATIONS

Akiyama et al., Method of Controlling Peltier Module for Air Conditioning, Aug. 9, 2012, JP 2012151211 A, whole document (Year: 2012).*

(Continued)

*Primary Examiner* — Elizabeth J Martin
*Assistant Examiner* — Adam Dorrel Moore
(74) *Attorney, Agent, or Firm* — Gene Vinokur

(57) ABSTRACT

A system for magnetic refrigeration is provided. The system includes a layered structure formed by a sequence of a plurality of magnetocaloric material (MCM) components interlinked with a sequence of a plurality of Peltier modules. Each Peltier module of the plurality of Peltier modules is sandwiched between two MCM components of the plurality of MCM components. The system further includes a power source configured to concurrently power each Peltier module in the sequence of the plurality of Peltier modules. Current in each powered Peltier module flows in a constant direction. The system further includes a magnetic source configured to apply spatially uniform magnetic field to the sequence of the plurality of MCM components.

18 Claims, 9 Drawing Sheets

(56) References Cited

U.S. PATENT DOCUMENTS

| | | | | |
|---|---|---|---|---|
| 2017/0138646 | A1* | 5/2017 | Ihnfeldt et al. | F25B 21/00 |
| 2017/0363333 | A1* | 12/2017 | Vetrovec | F25B 21/00 |
| 2018/0066875 | A1* | 3/2018 | Ihnfeldt | H10N 15/20 |
| 2018/0372381 | A1* | 12/2018 | Kitanovski | F25B 21/00 |

OTHER PUBLICATIONS

Tusek et al. Geometrical Optimization of packed bed and parallel plate active magnetic regenerators. International journal of regirdgeration 36 (2013) 1456-1464. Elsevier.

Tomc et al. A numerical comparison of a parallel plate amr and a magnetocaloric device with embodied micro thermoelectric thermal diodes. Internaitonal journal oni refrigeration 37 (2014) 185-193. Elsevier.

* cited by examiner

DEVICE AND METHOD FOR MAGNETIC REFRIGERATION

TECHNICAL FIELD

The present disclosure relates generally to magnetic refrigeration, and more particularly to a device and a method utilizing magnetocaloric material (MCM) components and Peltier modules for magnetic refrigeration.

BACKGROUND

Magnetic refrigeration is a technique utilized for cooling matter, such as solid materials, liquids or gas using a magnetic field. The magnetic refrigeration is a promising and an environmentally friendly technique compared to other existing technologies, for example, vapor-compression technology that are used for cooling the matter. The magnetic refrigeration works on a principle of magnetocaloric effect, where a magnetocaloric material (MCM) whose temperature can be controlled by application of the magnetic field on the MCM is used for refrigeration.

One of the constraints of using the MCM is that the MCM has a relatively small temperature change (e.g., about 5 Kelvin) under application of a reasonably accessible magnetic field strength (e.g., 1-2 Tesla). Moreover, from an implementation aspect, the MCM is a solid refrigerant that may not easily move between two spatially separate environments, thus, in order to guide a heat flow between the MCM, the MCM needs to be combined with other mechanisms.

The MCM may be utilized in various applications, such as Heating Ventilation and Air Conditioning (HVAC) systems. The HVAC systems used at home may include for example, refrigerators that utilize magnetic cooling devices based on MCM for cooling purposes. The conventional magnetic cooling devices involves usage of working fluid that flows between the cold and hot environments through the MCMs and thus exchanges heat between hot and cold environments. In the conventional magnetic cooling devices, controlling the flow of the fluid requires pumping and valving systems that inevitably complicates a design of the magnetic cooling devices and further increases the cost of production and maintenance of the magnetic cooling devices.

Furthermore, Peltier modules are another simple, lightweighted, solid cooling devices that may be utilized in the magnetic cooling devices. The Peltier modules utilize a thermoelectric effect to transfer heat from the cold to the hot environment. A Peltier module uses an applied current or voltage to guide the heat flow. However, one of the drawback of using the Peltier module is that an efficiency of the Peltier module, when quantified by the coefficient of performance (COP), drops quickly when a required temperature span (such as a required difference in temperature between the cold and hot environment) is large.

To that end, to address the aforesaid issues, there exists a need for improved devices that can overcome the above-stated disadvantages.

SUMMARY

The present disclosure provides a device and a method, i.e., a control protocol of applied magnetic field to MCM and/or applied currents to Peltier modules, for magnetic refrigeration.

Some embodiments disclose a device for magnetic refrigeration. The device includes a layered structure formed by a sequence of a plurality of MCM components interlinked with a sequence of a plurality of Peltier modules. Each Peltier module of the plurality of Peltier modules is sandwiched between two MCM components of the plurality of MCM components. The device further includes a power source configured to concurrently power each Peltier module in the sequence of the plurality of Peltier modules. A current in each powered Peltier module flows in a constant direction. The device further includes a magnetic source configured to apply spatially uniform magnetic field to the sequence of the plurality of MCM components.

Some embodiments are based on the recognition that conventional cooling devices that utilize the MCM require pumping and valving systems, that complicates the design of the magnetic cooling devices and further increases a cost of production and maintenance of the magnetic cooling devices.

Some embodiments are based on the recognition that the conventional cooling devices that utilize the Peltier modules have a reduced overall efficiency of the cooling devices, when the required temperature span is large.

Some embodiments are based on the realization that a layered structure formed by integration of the MCM components, and the Peltier module transfers heat from a cold environment to a hot environment. In the layered structure, the number of the MCM components is more than the number of Peltier modules. The MCM components and the Peltier modules are alternating in space. The integration of the MCM components and the Peltier modules enables reduction in a required number of the pumping and valving systems, as the heat transfer between the MCM components is performed by using the Peltier modules.

Some embodiments are based on the realization that a first layer in the layered structure is a first MCM component and a last layer in the layered structure is a last MCM component, thus, the MCM components at two ends interact with the environment directly. Moreover, each Peltier module in the layered structure is sandwiched between adjacent MCM components. As the Peltier modules in the layered structure do not directly interact with the environment, the heat transfer between the Peltier modules and the environments is reduced, thereby, enabling enhancement of efficiency measured in terms of the COP as compared to the conventional cooling devices.

Some embodiments are based on the realization that a spatially uniform magnetic field may be generated by usage of a pair of coils or permanent magnets. During a cooling cycle of the layered structure, a current applied to each of the Peltier modules is same, constant in time and flows in a constant direction.

Some embodiments disclose a method for magnetic refrigeration. The method includes forming a layered structure that includes a sequence of a plurality of magnetocaloric material (MCM) components interlinked with a sequence of a plurality of Peltier modules. Each Peltier module of the plurality of Peltier modules is sandwiched between two MCM components of the plurality of MCM components. The method further includes simultaneously applying current to each Peltier module in the sequence of the plurality of Peltier modules by using a power source. A current in each powered Peltier module flows in a constant direction. The method further includes applying spatially uniform magnetic field to the sequence of the MCM components of the plurality of MCM components, by using a magnetic source.

BRIEF DESCRIPTION OF THE DRAWINGS

The presently disclosed embodiments will be further explained with reference to the attached drawings. The drawings shown are not necessarily to scale, with emphasis instead generally being placed upon illustrating the principles of the presently disclosed embodiments.

DETAILED DESCRIPTION

Figure 1:
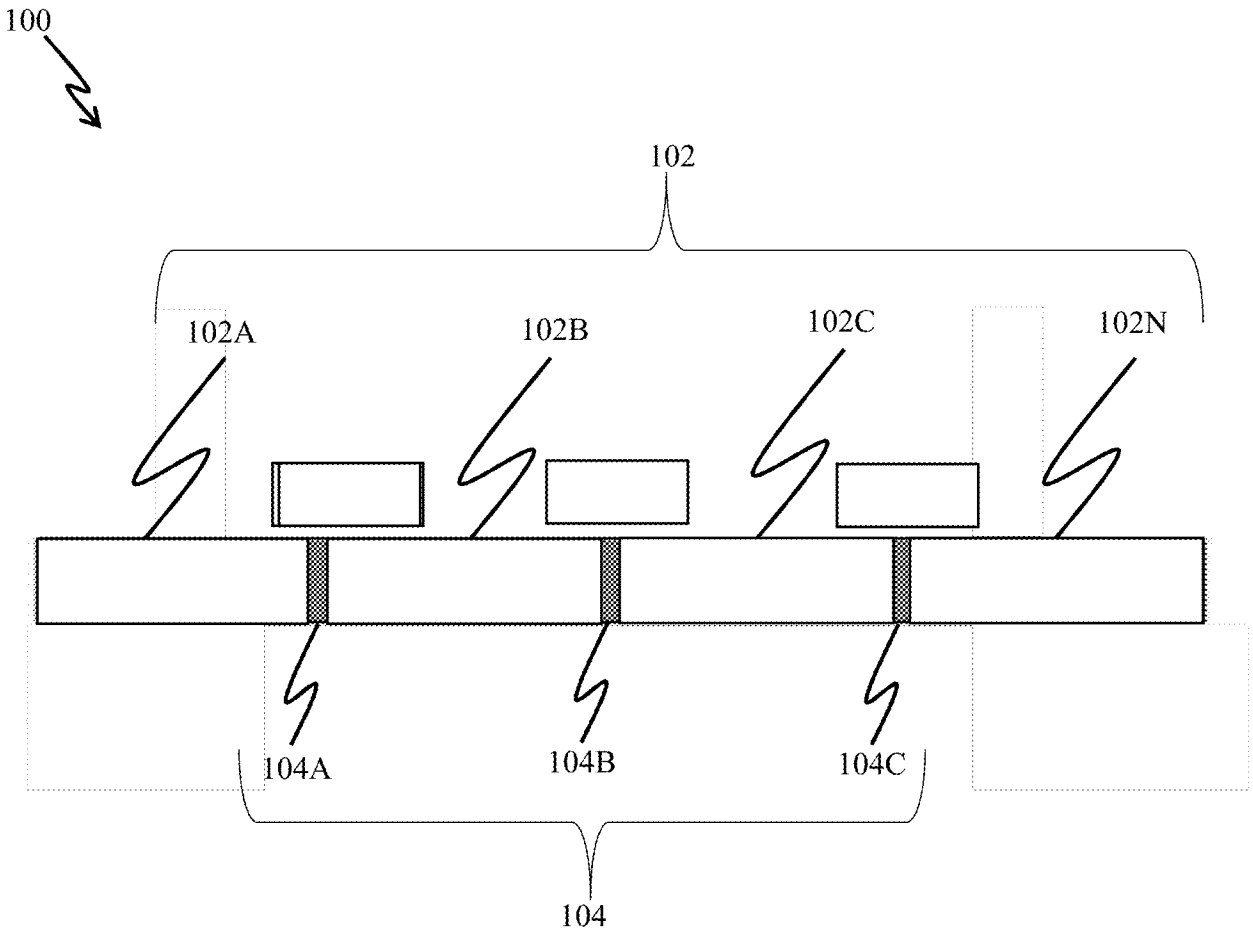
FIG. 1 shows an example device for magnetic refrigeration, according to some embodiments of the present disclosure.

It is an object of some embodiments to disclose a device for magnetic refrigeration. It is another object of some embodiments to disclose a method for magnetic refrigeration. The proposed device of the present disclosure for the magnetic refrigeration may include a layered structure. The layered structure may be formed by a sequence of a plurality of magnetocaloric material (MCM) components interlinked with a sequence of a plurality of Peltier modules. The sequence of the plurality of MCM components and the plurality of Peltier modules enables reduction in a required number of the pumping and valving systems as compared to conventional systems that requires the pumping and valving systems with each MCM module, as heat transfer between the plurality of MCM components is performed by using the plurality of Peltier modules in the proposed device. Moreover, in conventional systems that utilizes the Peltier modules, the Peltier modules may be in direct contact with an environment, that limits the heat transferred to the environments, thereby reducing an efficiency of the system. On the contrary, the layered structure of the device of the present disclosure includes a first layer and a last layer in contact with the environment as MCM components of the plurality of MCM components. Therefore, the heat transfer between the plurality of Peltier modules and the environment is enhanced, thereby, enabling enhancement of the efficiency measured in terms of a COP (coefficient of performance) as compared to the conventional systems or cooling devices.

The proposed device of the present disclosure may be utilized in various applications, such as in Heating Ventilation and Air Conditioning (HVAC) systems.

Typically, core of magnetic cooling in the HVAC systems is a magnetocaloric (MC) effect, which states that a temperature of the MCM increases upon applying a magnetic field and reduces upon removing the magnetic field. The magnetic cooling requires a magnetic field source that may be generated by usage of external coils or a permanent magnet. A magnetic cooling cycle corresponding to the magnetic cooling may be divided into four phases. In a first phase of the magnetic cooling cycle, the MCM enters a region of magnetic field generated by the external magnetic field source and becomes hotter. In a second phase of the magnetic cooling cycle, the hot MCM dissipates heat to a hot environment and a temperature of the MCM is lowered. In a third phase of the magnetic cooling cycle, the MCM leaves the region of the magnetic field and the temperature of the MCM becomes colder as compared to the temperature of the MCM in the second phase. In a fourth phase, the MCM absorbs heat from the cold environment and the temperature of the MCM increases. The change in temperature upon applying and removing the magnetic field, which occurs at the first phase and the third phase, is caused by magnetization and demagnetization of the MCM. In the fourth phase, the cooling actually occurs.

It may be noted that, the change in temperature of the MCM, for example, made of a material Gadolinium (Gd) observed upon applying a 2-Tesla magnetic field may be approximately 5 degree Celsius. In order to maintain a large temperature span (such as the change in temperature), a heat generation or a heat cascading mechanism may be required.

A conventional magnetic cooling cycle involves a working fluid and a bidirectional pump. Moreover, a hot heat exchanger and a cold heat exchanger are required to exchange heat with the hot and the cold environments respectively. In a setup for the conventional magnetic cooling cycle, a long sequence of MCM may be used, for example. Further, the external magnetic field may be generated by usage of the permanent magnets. The operation may be defined in two phases. In a first phase, the magnetic field is removed for the MCM. In such a case, the MCM becomes cold. Thus, the working fluid flows along a direction where the working fluid that leaves the MCM that is cold enters the cold heat exchanger to cool the cold environment. In a second phase, the magnetic field is applied to the MCM. The MCM becomes hot and the working fluid flows along a reverse direction where the working fluid that leaves the MCM to the hot heat exchanger to release heat to the hot environment. Repeating this process continuously transfers the heat from the cold to the hot environment.

It may be noted that a rational behind the working fluid is that the MCM which is a solid material is less mobile than the working fluid. Thus, once the working fluid is included, the pumping or valving components are needed in the conventional system. Moreover, the pumping or the valving sequence has to synchronize with that of the change in the magnetic field. This inevitably increases the complexity of the cooling device in the conventional cooling systems. The proposed device enables reduction in the usage of the pumping and valving systems to overcome the disadvantages of the conventional cooling systems. Details of the device and the method for the magnetic refrigeration are further provided, for example, from FIG. 1 till FIG. 6.

FIG. 1 shows an example device 100 for magnetic refrigeration, in accordance with an embodiment of the present disclosure. The device 100 may include a layered structure formed by a sequence of a plurality of MCM components 102 interlinked with a sequence of a plurality of Peltier modules 104. The plurality of MCM components 102 may include n number of MCM components, such as a first MCM component 102A, a second MCM component 102B, a third MCM component 102C and an Nth MCM component 102N. The plurality of Peltier modules 104 may include n number of Peltier modules, such as a first Peltier module 104A, a second Peltier module 104B and a third Peltier module 104C.

Each Peltier module of the plurality of Peltier modules 104 may be sandwiched between two MCM components of the plurality of MCM components 102. Thus, the number of the Peltier modules of the plurality of Peltier modules 104 may be less than the number of the MCM components of the plurality of MCM components 102. For example, the first Peltier module 104A may be sandwiched between the first MCM component 102A and the second MCM component 102B. The second Peltier module 104B may be sandwiched between the second MCM component 102B and the third MCM component 102C. The third Peltier module 104C may be sandwiched between the third MCM component 102C and the Nth MCM component 102N.

In some embodiments, a first layer in the layered structure may be the first MCM component 102A in the sequence of the plurality of MCM components 102, and a last layer in the layered structure is a last MCM component in the sequence of the plurality of MCM components 102. The first layer and the last layer may be end layers of the layered structure. For example, the first layer may correspond to the first MCM component 102A of the layered structure. The last MCM component may correspond to the Nth MCM component 102N of the plurality of MCM components 102. Thus, the first MCM component 102A and the Nth MCM component 102N (such as the last MCM component) of the layered structure may be in direct contact with the environment. In conventional cooling devices, the Peltier modules are in direct contact with the environment that may lead to loss of heat in the environment. On the contrary, in the device of the present disclosure, as the first MCM component 102A and the Nth MCM component 102N are in direct contact with the environment, such a configuration enables reduction or elimination of the heat loss due to no contact of the Peltier modules with the environment.

In some embodiments, a second layer in the layered structure is the first Peltier module 104A, a third layer in the layered structure is the second MCM component 102B and a fourth third layer in the layered structure is the second Peltier module 104B. The second layer in the layered structure is an adjacent layer of the first layer in the layered structure. The second MCM component 102B that corresponds to the third layer is sandwiched between the first Peltier module 104A and the second Peltier module 104B. Similarly, the third MCM component 102C may be sandwiched between the second Peltier module 104B and the third Peltier module 104C. Thus, the layered structure may have a sequence of alternate MCM component and the Peltier module, such that the end layers of the layered structure are the MCM components of the plurality of MCM components 102.

In some embodiments, each MCM component of the plurality of MCM components 102 may be composed of a Gadolinium alloy. The Gadolinium has properties of both paramagnetic and ferromagnetic in nature. The Gadolinium is paramagnetic in nature at a room temperature and becomes ferromagnetic in nature when cooled at low temperatures (such as at 20 degree Celsius). The Gadolinium alloy may include different types of doping.

In some embodiments, a thickness of each MCM component in the sequence of the plurality of MCM components 102 is in a range of 0.1 centimeters (cm) to 1 cm. The thickness of each MCM component in the sequence of the plurality of MCM components 102 may be same. For example, the first MCM component 102A, the second MCM component 102B, the third MCM component 102N and the Nth MCM component 102N may have the thickness of 0.5 cm. In another example, the first MCM component 102A, the second MCM component 102B, the third MCM component 102N and the Nth MCM component 102N may have the thickness of 0.7 cm. In an embodiment, the thickness of each MCM component in the sequence of the plurality of MCM components 102 may be different. For example, the thickness of the first MCM component 102A may be 0.4 cm, the thickness of the second MCM component 102B may be 0.7 cm, the thickness of the third MCM component 102C may be 0.2 cm and the thickness of the Nth MCM component 102N may be 0.5 cm.

In some embodiments, each Peltier module of the plurality of Peltier modules 104 may include an n-doped semiconductor electrically connected with a p-doped semiconductor arranged in parallel with the n-doped semiconductor. The n-doped semiconductor and the p-doped semiconductor are placed across two metal plates. The p-doped semiconductor and the n-doped semiconductor are thermally in parallel and connected electrically in series. Details of the plurality of Peltier modules 104 are further described, for example, in FIG. 2A.

The device 100 further includes a power source configured to concurrently power each Peltier module in the sequence of the plurality of Peltier modules 104. A current in each powered Peltier module flows in a constant direction. By control of the current direction, a heat flux in the plurality of Peltier modules 104 may be controlled. Thus, the plurality of Peltier modules 104 may be utilized to transfer heat from one side to another side. In the device 100, each Peltier module may be configured to transfer the heat from one adjacent MCM component to another adjacent MCM component of the plurality of MCM components 102. For example, the first Peltier module 104A may transfer the heat from the first MCM component 102A to the second MCM component 102B. Similarly, the second Peltier module 104B may transfer the heat from the second MCM component 102B to the third MCM component 102C. Details of the powering of the plurality of Peltier modules 104 are further provided, for example, in FIG. 2A.

The device 100 further includes a magnetic source configured to apply spatially uniform magnetic field to the sequence of the plurality of MCM components 102. In an embodiment, the magnetic source may be magnetic coils. In another embodiment, the magnetic source may be a permanent magnet. As described above, the plurality of MCM components 102 may heat up upon application of the spatially uniform magnetic field. Similarly, the plurality of MCM components 102 may cool down upon removal of the spatially uniform magnetic field. Such principle of heating and cooling may be utilized by the device 100 for magnetic cooling purposes in the HVAC systems. Exemplary magnetic source is further described in FIG. 3A.

Figure 2A:
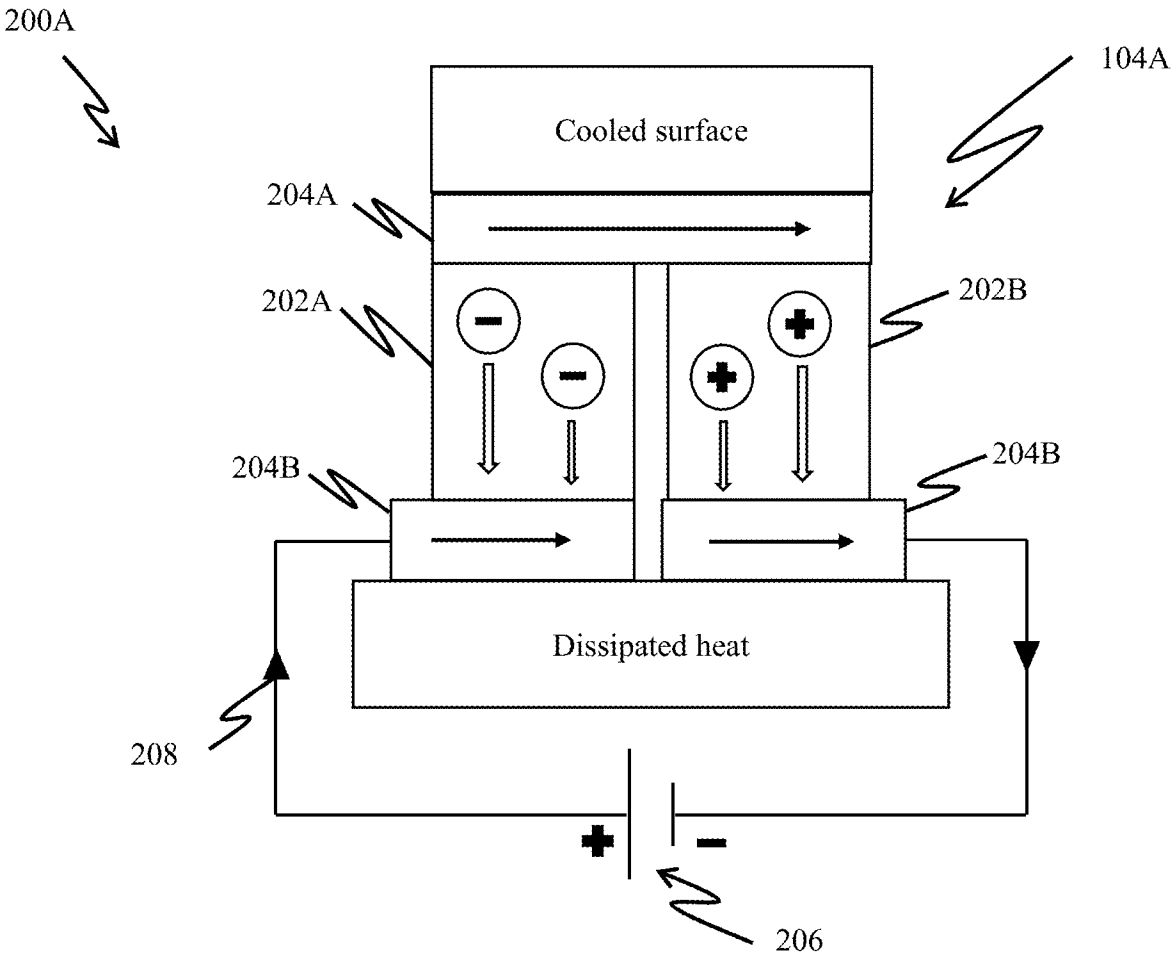
FIG. 2A shows an example configuration of a Peltier module, according to some embodiments of the present disclosure.

FIG. 2A shows an example configuration 200A of a Peltier module, in accordance with an embodiment of the present disclosure. The example configuration 200A may be implemented for each Peltier module of the sequence of the plurality of Peltier modules 104. The example configuration 200A is shown for the first Peltier module 104A. The first Peltier module 104A may include an n-doped semiconductor 202A electrically connected with a p-doped semiconductor 202B arranged in parallel with the n-doped semiconductor 202A. The n-doped semiconductor 202A and the p-doped semiconductor 202B are placed across two metal plates, such as a metal plate 204A and a metal plate 204B. The p-doped semiconductor 202B and the n-doped semiconductor 202A are thermally in parallel and connected electrically in series. The example configuration 200A further shows a power source 206 configured to concurrently power each Peltier module, such as the first Peltier module 104A in the sequence of the plurality of Peltier modules 104.

When applying the current along a direction 208, both charge carriers, such as holes in the p-doped semiconductor 202B and electrons in the n-doped semiconductor 202A, moves from a top direction to a downward direction. Such motion of the charge carriers generates the heat flux from the top direction to the downward direction independent of environment temperatures (such as the temperature of surroundings of the device 100). Therefore, by controlling the direction 208 of the applied current, the heat flux may be controlled. For example, the heat flux may be generated from the top direction to the downward direction or from the from the downward direction to the top direction.

In some embodiments, the n-doped semiconductor 202A and the p-doped semiconductor 202B are at least one of silicon based semiconductors or bismuth telluride based semiconductors. The materials used for the plurality of Peltier modules 104 may need to be thermoelectric materials. For example, the silicon and the bismuth telluride are the thermoelectric materials. In an embodiment, the n-doped semiconductor 202A and the p-doped semiconductor 202B may be lead telluride based semiconductors. A selection of the material for the plurality of Peltier modules 104 may be based on one or more parameters, such as thermal conductance K, Seebeck effect S, and electrical resistance R associated with the plurality of Peltier modules 104. A 3-parameter model for the plurality of Peltier modules 104 is further described in FIG. 2B.

Figure 2B:
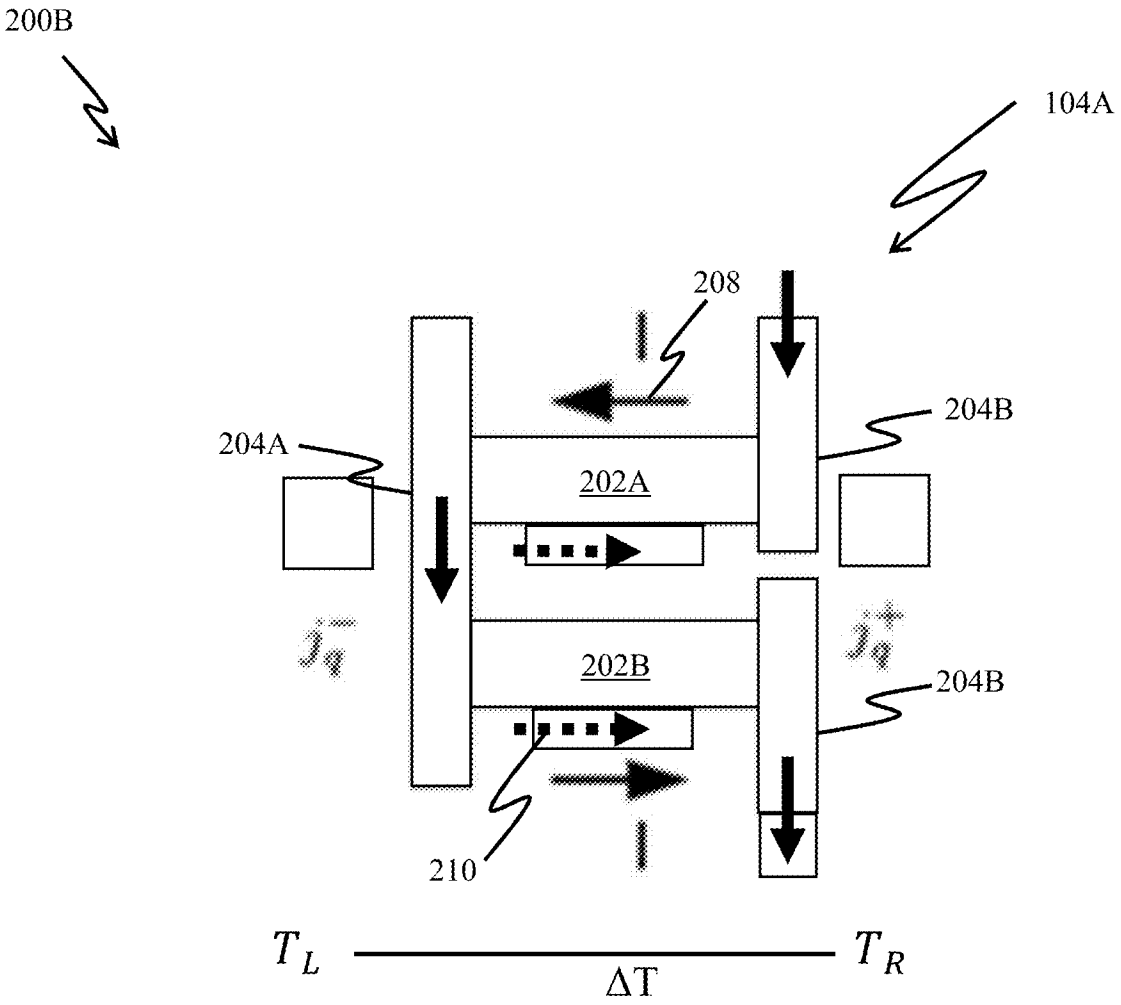
FIG. 2B shows a 3-parameter model for the Peltier module, according to some embodiments of the present disclosure.

FIG. 2B shows a 3-parameter model 200B for each Peltier module, in accordance with an embodiment of the present disclosure. The 3 parameters may be the thermal conductance K, the Seebeck effect S, and the electrical resistance R associated ith the plurality of Peltier modules 104. For the applied current (I) following the direction 208, both the charge carriers such as electrons in the n-doped semiconductor 202A and holes in the p-doped semiconductor 202B moves in a direction 210. i.e., from a left side to a right side.

Applying the current I to the Peltier modules, such as the first Peltier module 104A has two effects, i.e., a convective contribution to the heat flux represented as "SIT", where I is the current and T is the temperature, and a Ohm loss term $I^2R$.

The conduction in the first Peltier module 104A is represented as the following equation:

$$j_{cond} = -K(T_R - T_L) \tag{1}$$

where $j_{cond}$ represents the heat flux generated due to thermal conductance, K is the thermal conductance, $T_R$ is the temperature at the right side of the first Peltier module 104A and $T_L$ is the temperature at the left side of the first Peltier module 104A.

The Seebeck effect S in the in the first Peltier module 104A is represented as the following equations:

$$j^{+}_{Peltier} = SIT_L + \frac{I^2R}{2} \tag{2}$$

$$j^{-}_{Peltier} = SIT_L - \frac{I^2R}{2} \tag{3}$$

where $j_{Peltier}{}^{+}$ and $j_{Peltier}{}^{-}$ represents the heat flux generated due to the Seebeck effect.

The heat flux generated in the first Peltier module 104A is represented as the following equation:

$$j^{\pm}_{q} = j_{cond} + j^{\pm}_{Peltier} \tag{4}$$

where $j_q^{\pm}$ represents the heat flux generated in the first Peltier module 104A.

Once the temperature difference between two neighboring environments (ΔT) is known, for the applied current (I), the heat flux entering the left side and leaving the right side are respectively given by:

$$j_L = SIT_L - K(\Delta T) - \frac{I^2R}{2} \tag{5}$$

$$j_R = SIT_R - K(\Delta T) - \frac{I^2R}{2}$$

The parameters in the equation 5 and equation 6 may be determined by use of specification sheet of the plurality of Peltier modules 104.

Exemplary parameters of the specification sheet of the plurality of Peltier modules 104 are shown in the following table:

TABLE 1

Parameters of the specification sheet where $\Delta T_{max}$ is the maximum difference in the temperature, $V_{\Delta Tmax}$ is the voltage across the Peltier module at the maximum difference in the temperature, $I_{\Delta Tmax}$ is the current applied to the Peltier module at the maximum difference in the temperature, $j_{max}$ is the maximum heat flux generated in the Peltier module, S/A represents Seebeck effect per area of the Peltier module, R/A represents resistance per area of the Peltier module, and K/A represents thermal conductivity per area of the Peltier module.

| Exemplary Module | Dimension (centimeter) | R (Ω) | $\Delta T_{max}$, $T_{hot}$, $T_{cold}$ | $V_{\Delta Tmax}$ (V) | $I_{\Delta Tmax}$ (A) | $j_{max}$ (W) | S/A (V/Kcm$^2$) | R/A (Ω/cm$^2$) | K/A (W/Kcm$^2$) |
|---|---|---|---|---|---|---|---|---|---|
| First Peltier module | 1*1*0.3 | 0.95 | 68, 300, 232 | 8.8 | 0.8 | 3.7 | 0.02933 | 9.85 | 0.035 |

TABLE 1-continued

Parameters of the specification sheet where $\Delta T_{max}$ is the maximum difference in the temperature, $V_{\Delta Tmax}$ is the voltage across the Peltier module at the maximum difference in the temperature, $I_{\Delta Tmax}$ is the current applied to the Peltier module at the maximum difference in the temperature, $j_{max}$ is the maximum heat flux generated in the Peltier module, S/A represents Seebeck effect per area of the Peltier module, R/A represents resistance per area of the Peltier module, and K/A represents thermal conductivity per area of the Peltier module.

| Exemplary Module | Dimension (centimeter) | R (Ω) | $\Delta T_{max}$, $T_{hot}$, $T_{cold}$ | $V_{\Delta Tmax}$ (V) | $I_{\Delta Tmax}$ (A) | $j_{max}$ (W) | S/A (V/Kcm$^2$) | R/A (Ω/cm$^2$) | K/A (W/Kcm$^2$) |
|---|---|---|---|---|---|---|---|---|---|
| Second Peltier module | 5.4*3.6*0.36 | 0.33 | 70, 300, 230 | 8.5 | 20 | 96 | 0.00146 | 0.017 | 0.047 |

Furthermore, equation 6 enables quantification of a performance of the plurality of Peltier modules 104. One important figure of merit is a COP (coefficient of performance), defined by a ratio of cooling power and input work to the plurality of Peltier modules 104. For the plurality of Peltier modules 104, the COP is defined by the following equation:

$$COP = \frac{j_L}{W_{Peltier}} = \frac{SIT_L - K\Delta T - \frac{I^2R}{2}}{SI\Delta T + I^2R} \tag{7}$$

The larger a value of the COP, more efficient is the cooling power of the device 100.

Figure 3A:
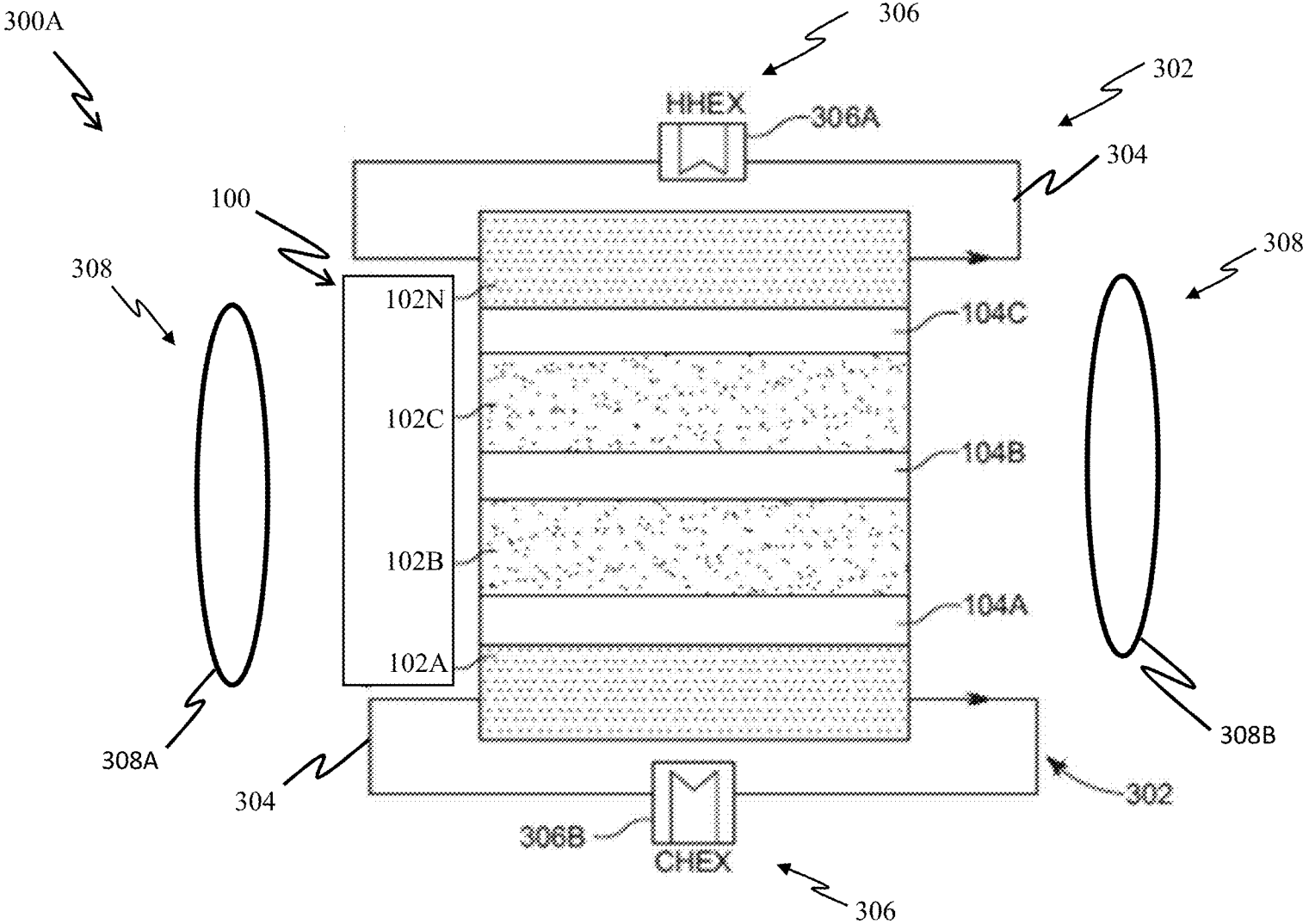
FIG. 3A shows a first exemplary configuration of the device for magnetic refrigeration, according to some embodiments of the present disclosure.
Figure 3B:
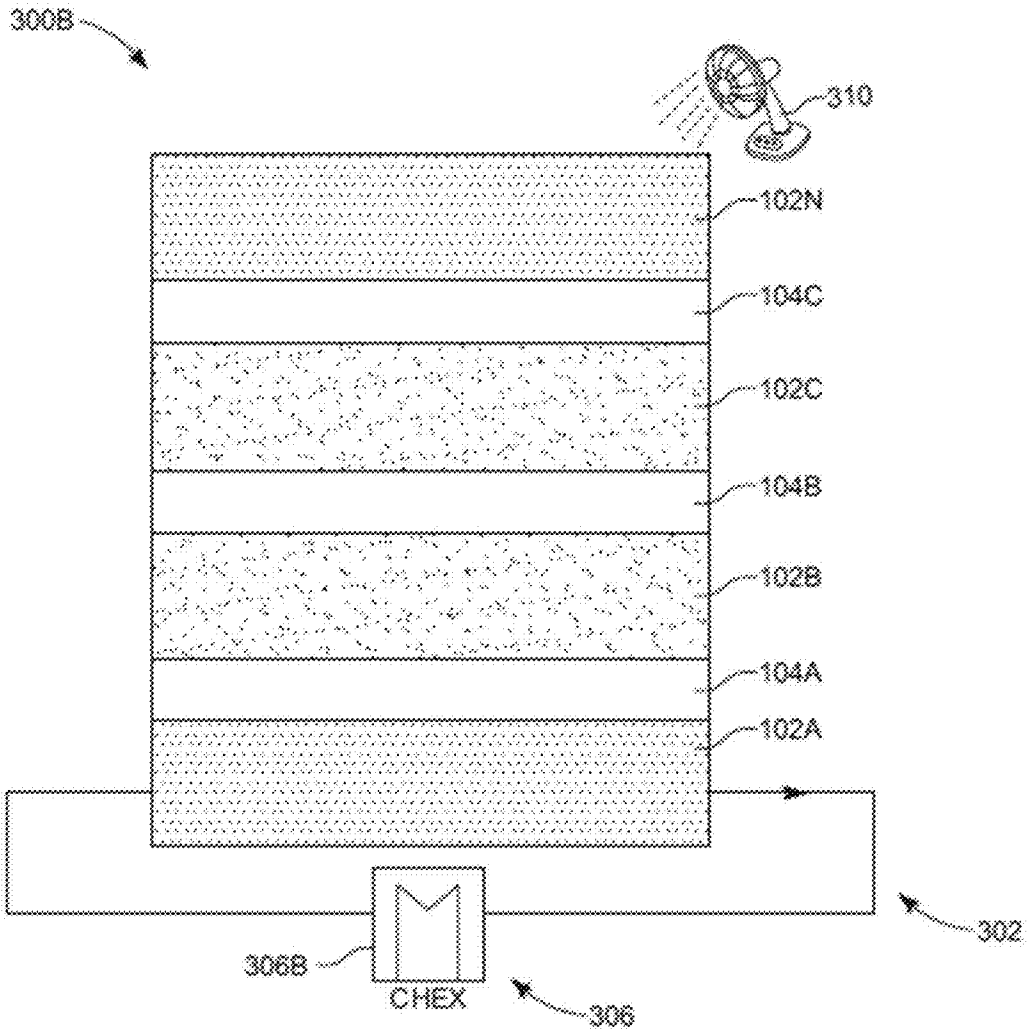
FIG. 3B shows a second exemplary configuration of the device for magnetic refrigeration, according to some embodiments of the present disclosure.
Figure 3C:
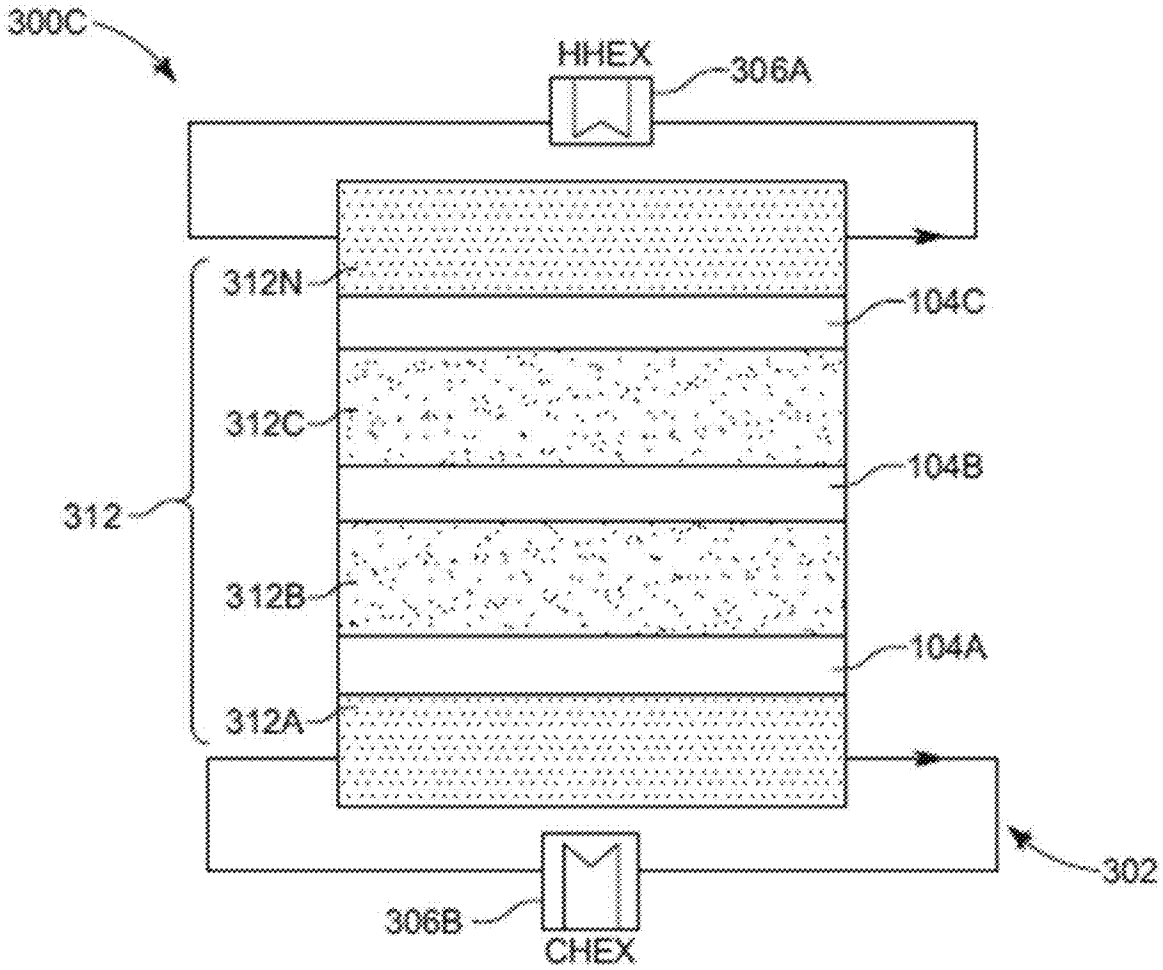
FIG. 3C shows a third exemplary configuration of the device for magnetic refrigeration, according to some embodiments of the present disclosure.

Exemplary configurations of the device 100 are further described in FIG. 3A, FIG. 3B and FIG. 3C.

FIG. 3A shows a first exemplary configuration 300A of the device 100 for magnetic refrigeration, in accordance with an embodiment of the present disclosure. The exemplary configuration 300A of the device 100 shows the alternate sequence of the plurality of MCM components 102 and the plurality of Peltier modules 104. The first layer is the first MCM component 102A and the last layer is the Nth MCM component 102N.

In some embodiments, in the exemplary configuration 300A, at least the first MCM component 102A and the last MCM component (such as the Nth MCM component 102N) in the sequence of the plurality of MCM components 102 is coupled to a cooling unit 302. The cooling unit 302 may include at least one of a pipe 304, a working fluid and a heat exchanger 306. The heat exchanger 306 may include a hot heat exchanger 306A and a cold heat exchanger 306B. The exemplary configuration 300A may further include the magnetic source as magnetic coils 308, such as a magnetic coil 308A and a magnetic coil 308B.

When the magnetic field is applied to the device 100 by use of the magnetic coil 308A and the magnetic coil 308B, each MCM component of the plurality of MCM components 102 heats up. When the magnetic field is removed from the device 100, the plurality of MCM components 102 cools down. The first layer having the first MCM component 102A and the last layer having the Nth MCM component 102N are in direct contact with two working fluids. The working fluids comes in contact with the first MCM component 102A and the Nth MCM component 102N via the pipe 304. The working fluids exchange heat with the hot heat exchanger 306A and the cold heat exchanger 306B.

In some embodiments, at least the first MCM component 102A and the last MCM component 102N in the sequence of the plurality of MCM components 102 possesses a porous structure. The direct contact of the first MCM component 102A and the last MCM component 102N having the porous structure enhances the heat transfer between the first MCM component 102A and the last MCM component 102N and the working fluids, that may be required crucial for enhancement of the COP. In an embodiment, each MCM component of the plurality of MCM components 102 possesses the porous structure.

FIG. 3B shows a second exemplary configuration 300B of the device 100 for magnetic refrigeration, in accordance with an embodiment of the present disclosure. The second exemplary configuration 300B depicts another type of the cooling unit, that excludes the hot heat exchanger 306A.

In some embodiments, the first MCM component 102A or the last MCM component in the sequence of the plurality of MCM components 102 may receive air for cooling via a fan 310. For example, the first MCM component 102A is cooled by using the fan 310. In such a case, the cooling unit may be absent of the hot heat exchanger 306A as the cooling is performed by the fan 310. The second exemplary configuration 300B enables further reduction in the number of the pipes 304 required for the cooling of the plurality of MCM components 102, thereby. Thus, the device 100 may be economically cheaper and may have reduced structural complexity as compared to the conventional cooling systems.

FIG. 3C shows a third exemplary configuration 300C of the device 100 for magnetic refrigeration, in accordance with an embodiment of the present disclosure. The third exemplary configuration 300C depicts a plurality of MCM components 312 with different amount of doping. The plurality of MCM components 312 may include a first MCM component 312A, a second MCM component 312B, a third MCM component 312C and an Nth MCM component 312N.

The amount of doping in the plurality of MCM components 312 may depend upon the temperature span required in the device 100. The plurality of MCM components 312 may be doped to further enhance the cooling performance of the device 100. For example, the first MCM component 312A may be selected based on the temperature in the cold heat exchanger 306B. Similarly, the Nth MCM component 312N may be selected based on the temperature in the hot heat exchanger 306A. Thus, in the third exemplary configuration 300C, each MCM component may function at different temperature ranges.

Further, an optimum number of the MCM components for the plurality of MCM components 102 may be determined. The difference in COP for different number of the MCM components is described in FIG. 4.

Figure 4:
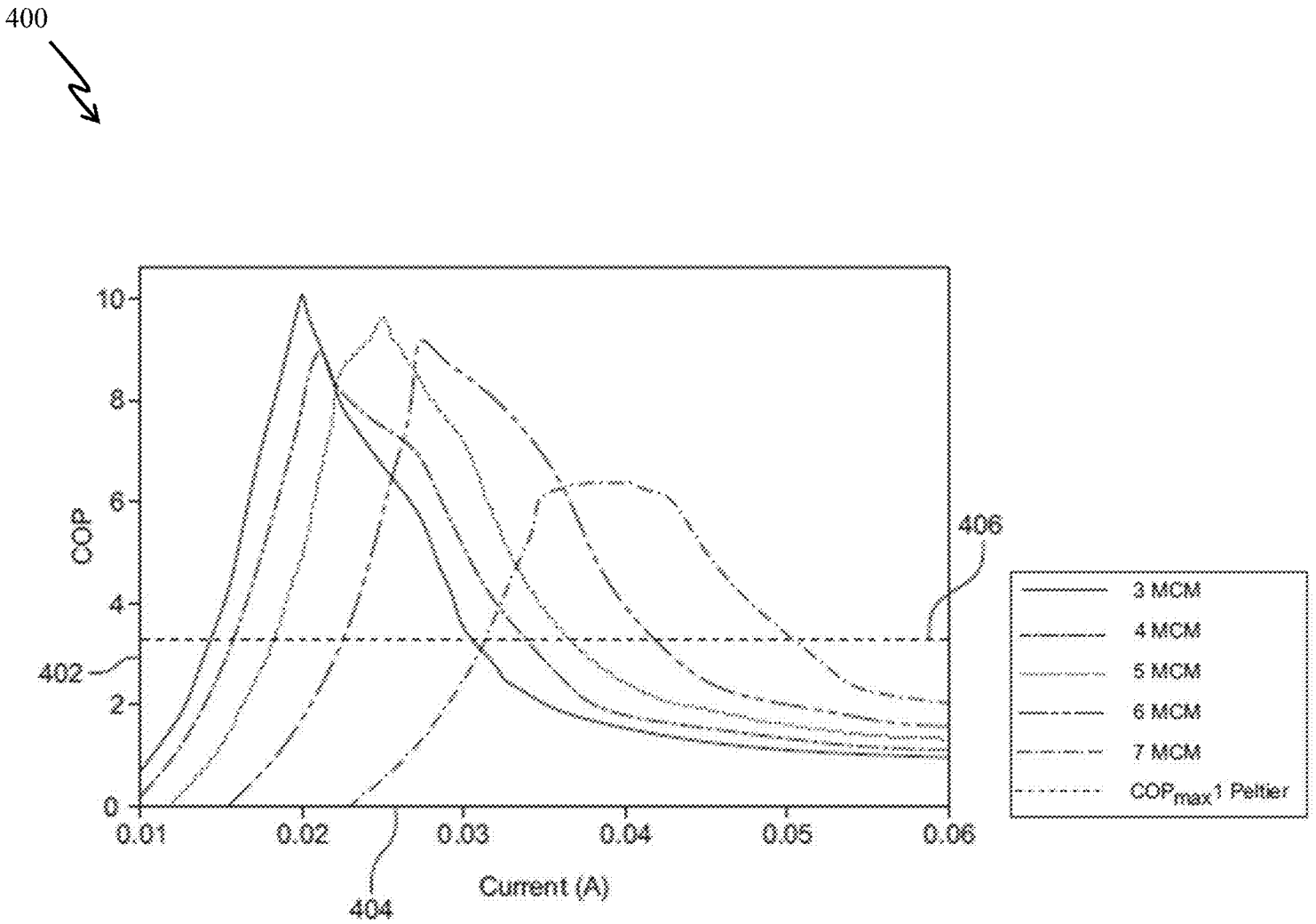
FIG. 4 shows a graph depicting different coefficient of performance (COP) corresponding to the device with different number of magnetocaloric material (MCM) components, according to some embodiments of the present disclosure.

FIG. 4 shows a graph 400 depicting different COP corresponding to the device 100 with different number of MCM components, in accordance with an embodiment of the present disclosure. The graph 400 includes a Y-axis 402 representing the COP and an X-axis 404 representing the current.

The current applied to each Peltier module of the plurality of Peltier modules 104 is to generate the heat flux from the bottom to the top, i.e., from the cold environment corresponding to the cold heat exchanger 306B to the hot environment corresponding to the hot heat exchanger 306A. In principle, the current applied to each Peltier module may be different. The current applied to each Peltier module may be time dependent. Such degrees of freedom may be explored to further enhance the cooling performance.

In the device 100, the current applied to each Peltier modules of the plurality of Peltier modules 104 is the same and are constant in time. The graph 400 shows a relationship of the COP with the current, in case of 3 number of MCM components, 4 number of MCM components, 5 number of MCM components, 6 number of MCM components, and 7 number of MCM components in the plurality of MCM components 102. Moreover, using "N" number of the MCM components requires "N−1" number of the Peltier modules.

Moreover, a time-dependence of the magnetic field is assumed as the following equation:

$$H_n(T) = H_0\left[\theta\left(T - 9n + 1/2\right) - \Theta(T - (n+1)P_0)\right] \tag{8}$$

where $H_n(t)$ is the magnetic field at time 't', $P_0$ is a time period which is taken to be 1 second, and n denotes nth cycle. $H_0$ is the strength of the magnetic field, which is taken to be 2 Tesla. The plurality of MCM components 102 are cooled at $t=nP_0$ and are heated at $t=(n+½)P_0$. The temperature span is taken to be between 280 Kelvin (K) and 290 K.

A dotted line 406 represents the optimum COP achieved by using only the Peltier modules in the conventional cooling devices. The value of COP is about 3.5 in the conventional cooling devices. In the device 100 that includes the sequence of the plurality of MCM components 102 and the plurality of Peltier modules 104, the COP is increased to approximately 9.5, that is approximately 2.6 times larger than the best value allowed using only the Peltier modules in the conventional cooling devices. Thus, the device 100 provides an enhancement of the COP as compared to the conventional cooling devices. Moreover, upon increasing the number of MCM components more than 7, the COP value appears to saturate. Furthermore, a temperature distribution at different moments of the cooling cycle of the device 100 is explained in FIG. 5.

Figure 5:
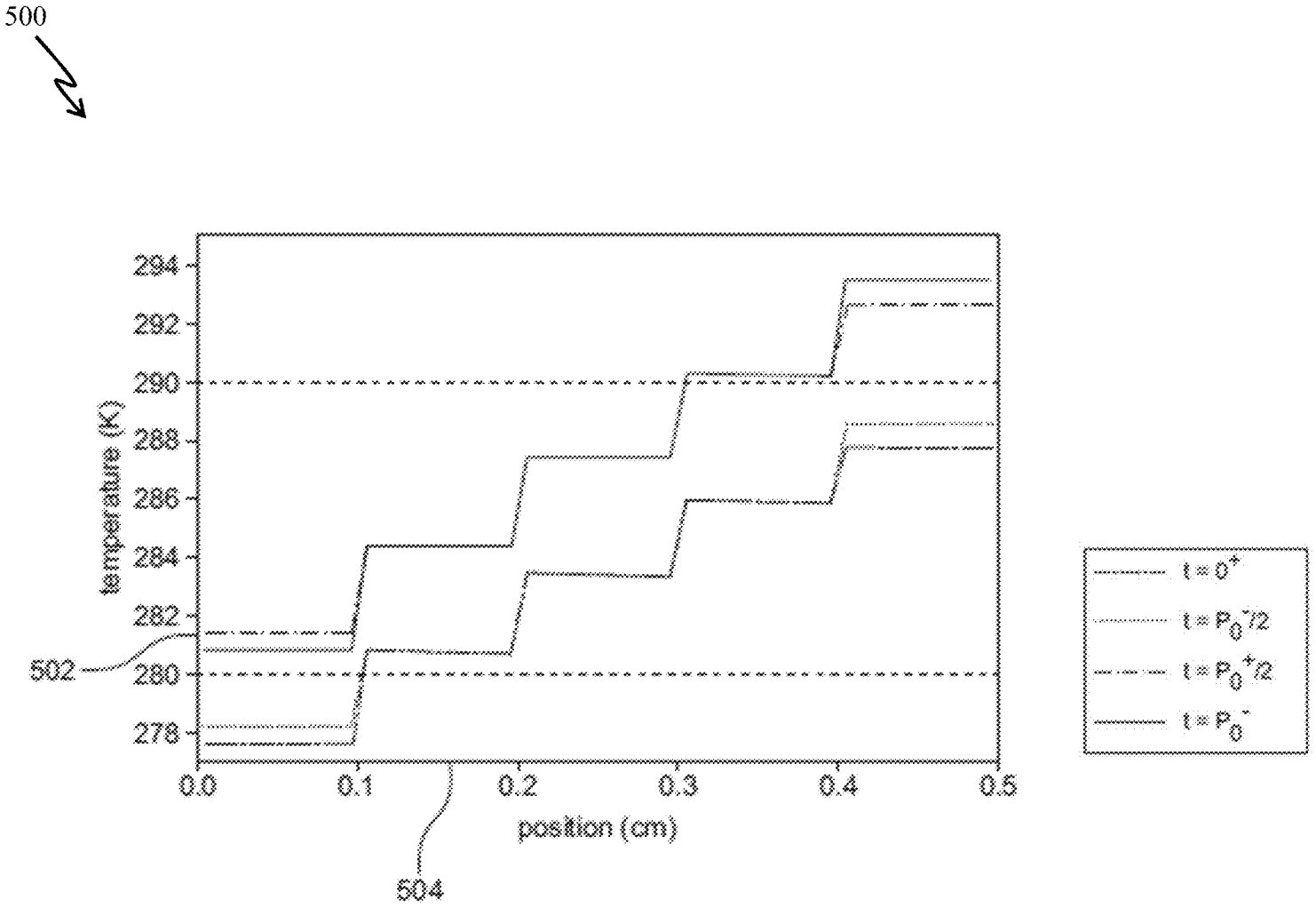
FIG. 5 shows a graph depicting temperature distribution at four critical moments of cooling cycle of the device, according to some embodiments of the present disclosure.

FIG. 5 shows a graph 500 depicting temperature distribution at four critical moments of cooling cycle of the device 100, in accordance with an embodiment of the present disclosure. The graph 500 includes an X-axis 502 representing the temperature in Kelvin and a Y-axis 504 representing a position in cm corresponding to the device 100.

The spatial temperature distribution is depicted for four critical moments of cooling cycle, such as $t=0^-$, $0^+$, $P_0^-/2$, $P_0^+/2$. The temperature distribution has jumps across the plurality of Peltier modules 104, that are caused by the applied currents. The end MCM components, such as the first MCM component 102A and the Nth MCM component 102N may be hotter than the hot environment and colder than the cold environment, that enhances the heat transfer between plurality of MCM components 102 and the environment. An overall design strategy for the device 100 is further described.

A first step is to determine the number of the MCM components of the sequence of the plurality of MCM components 102. In some embodiments, the number of the MCM components in the sequence of the plurality of MCM components 102 is determined based on a required difference in temperature (such as the temperature span) between the first MCM component 102A and the last MCM component, such as the Nth MCM component 102N in the sequence of the plurality of MCM components 102. It may be noted that, applying and removing the magnetic field can only induce a temperature change of dT (<5K). For a required temperature span of $T_{span}$, the number of the MCM components required is approximately:

$$N_{MCM} \text{ units} = 2T_{span}/dT \tag{9}$$

A second step is to determine the thickness of the plurality of MCM components 102. From entropy consideration, a thin MCM component is preferred. In practice, the thickness of each MCM component in the sequence of the plurality of MCM components 102 is in the range of 0.1 cm to 1 cm.

A third step is to determine the current applied to the plurality of Peltier modules 104. In some embodiments, an amount of the current provided to each powered Peltier module is determined maximizing the COP based on the number of the MCM components and the target temperature span selected for the magnetic refrigeration. The current applied may be determined by use of the graph 400. The current applied may be selected based on the number of the MCM components required for the optimum COP, the optimum COP, such as (9.5). As shown in the graph 400, the COP with the 7 number of the MCM components is approximately 10. The current corresponding to the COP of 10 is approximately 0.02 Amperes. Thus, by selecting the number of the MCM components in the plurality of MCM components 102, the thickness of the MCM components and the current to be applied to the plurality of Peltier modules 104, the device 100 may be designed.

Figure 6:
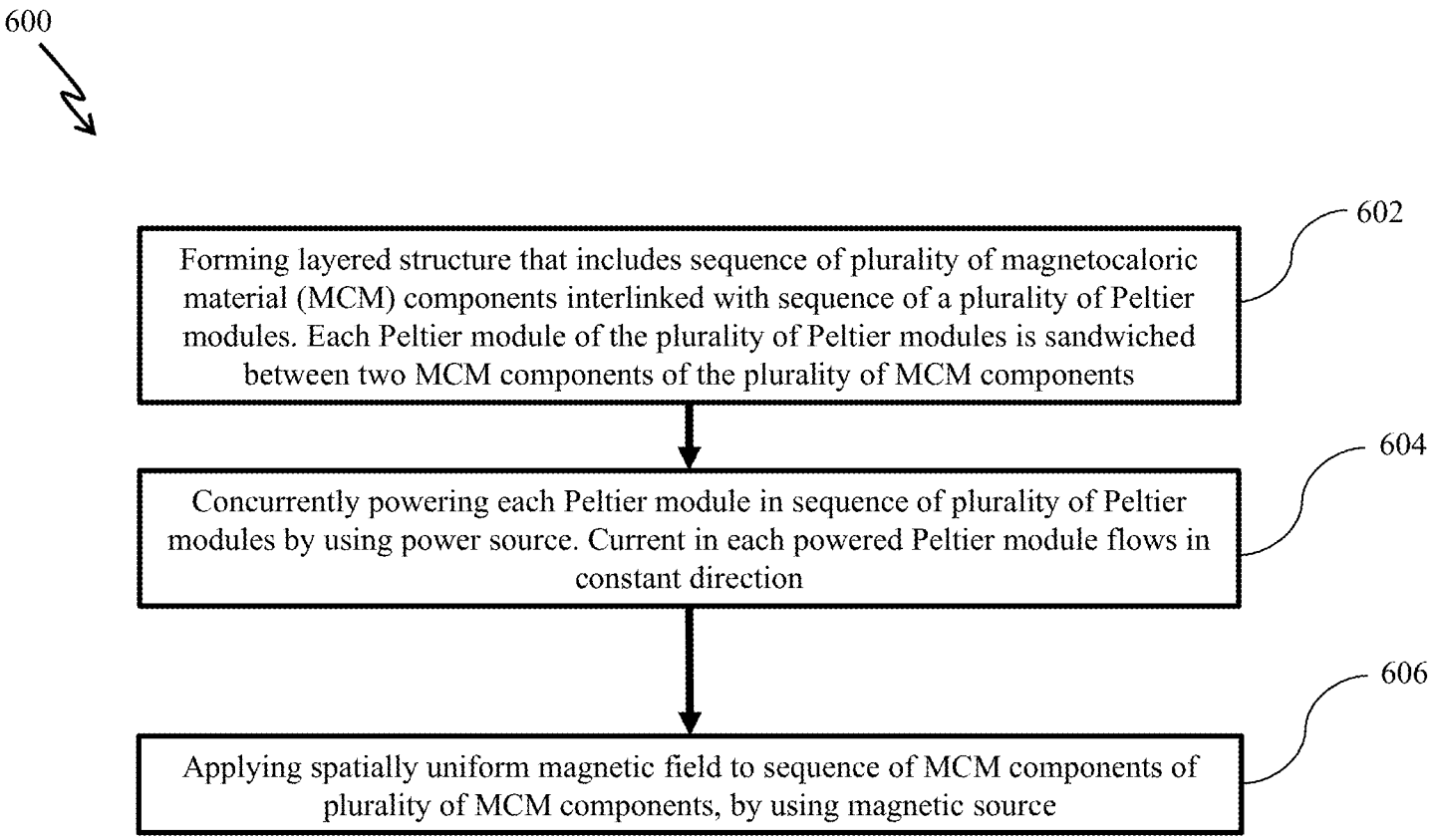
FIG. 6 shows a flowchart of a method for the magnetic refrigeration using the device, according to some an embodiments of the present disclosure.

FIG. 6 shows a flowchart of a method 600 for the magnetic refrigeration using the device 100, in accordance with an embodiment of the present disclosure.

At a step 602, the layered structure that includes the sequence of the plurality of MCM components 102 interlinked with the sequence of the plurality of Peltier modules 104 is formed. Each Peltier module of the plurality of Peltier modules 104 is sandwiched between the two MCM components of the plurality of MCM components 102. Details of the layered structure are further provided, for example, in FIG. 1.

At a step 604, each Peltier module in the sequence of the plurality of Peltier modules 104 is concurrently powered by using the power source 206. The current in each powered Peltier module flows in the constant direction. Details of the powering of the plurality of Peltier modules 104 are further provided, for example, in FIG. 2A.

At a step 606, the spatially uniform magnetic field is applied to the sequence of the plurality of MCM components 102, by using the magnetic source 308. Details of the magnetic source 308 are further provided, for example, in FIG. 3A.

The above description provides exemplary embodiments only, and is not intended to limit the scope, applicability, or configuration of the disclosure. Rather, the following description of the exemplary embodiments will provide those skilled in the art with an enabling description for implementing one or more exemplary embodiments. Contemplated are various changes that may be made in the function and arrangement of elements without departing from the spirit and scope of the subject matter disclosed as set forth in the appended claims.

Specific details are given in the following description to provide a thorough understanding of the embodiments. However, if understood by one of ordinary skill in the art, the embodiments may be practiced without these specific details. For example, systems, processes, and other elements in the subject matter disclosed may be shown as components in block diagram form in order not to obscure the embodiments in unnecessary detail. In other instances, well-known processes, structures, and techniques may be shown without unnecessary detail to avoid obscuring the embodiments. Further, like reference numbers and designations in the various drawings indicated like elements.

Also, individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed but may have additional steps not discussed or included in a figure. Furthermore, not all operations in any particularly described process may occur in all embodiments. A process may correspond to a method, a function, a procedure, a subroutine, a subprogram, etc. When a process corresponds to a function, the function's termination can correspond to a return of the function to the calling function or the main function.

Furthermore, embodiments of the subject matter disclosed may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

Various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. Typically, the functionality of the program modules may be combined or distributed as desired in various embodiments.

Individual embodiments above are described as a process which is depicted as a flowchart, a flow diagram, a data flow diagram, a structure diagram, or a block diagram. Although a flowchart shows the operations as a sequential process, many of the operations can be performed in parallel or concurrently. In addition, the order of the operations may be re-arranged. A process may be terminated when its operations are completed but may have additional steps not discussed or included in a figure. Furthermore, not all operations in any particularly described process may occur in all embodiments. A process may correspond to a method, a function, a procedure, a subroutine, a subprogram, etc. When a process corresponds to a function, the function's termination can correspond to a return of the function to the calling function or the main function.

Furthermore, embodiments of the subject matter disclosed may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

Many modifications and other embodiments of the disclosure set forth herein will come to mind to one skilled in the art to which these disclosure pertain having the benefit of the teachings presented in the foregoing descriptions and the associated drawings. It is to be understood that the disclosure are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

The invention claimed is:

1. A device for magnetic refrigeration, comprising:

a layered structure formed by a sequence of a plurality of magnetocaloric material (MCM) components interlinked with a sequence of a plurality of Peltier modules, wherein each Peltier module of the plurality of Peltier modules is sandwiched between two MCM components of the plurality of MCM components and transfers heat between two adjacently arranged MCM components of the plurality of MCM components, wherein a first layer in the layered structure is a first MCM component in the sequence of the plurality of MCM components and a last layer in the layered structure is a last MCM component in the sequence of the plurality of MCM components, wherein the first MCM component and the last MCM component interact with hot and cold environments to enable transfer of heat between the hot and cold environments;

a power source configured to concurrently power each Peltier module in the sequence of the plurality of Peltier modules, wherein current in each powered Peltier module flows in a constant direction; and a magnetic source configured to apply spatially uniform magnetic field to the sequence of the plurality of MCM components.

2. The device of claim 1, wherein at least the first MCM component and the last MCM component in the sequence of the plurality of MCM components possesses a porous structure.

3. The device of claim 1, wherein at least the first MCM component and the last MCM component in the sequence of the plurality of MCM components is coupled to a cooling unit, wherein the cooling unit includes at least one of: a pipe, a working fluid and a heat exchanger.

4. The device of claim 1, wherein the first MCM component or the last MCM component in the sequence of the plurality of MCM components receives air for cooling via a fan.

5. The device of claim 1, wherein a second layer in the layered structure is a first Peltier module, a third layer in the layered structure is a second MCM component and a fourth layer in the layered structure is a second Peltier module, and wherein the second MCM component is sandwiched between the first Peltier module and the second Peltier module.

6. The device of claim 1, wherein each MCM component of the plurality of MCM components is composed of a Gadolinium alloy.

7. The device of claim 1, wherein a number of the MCM components in the sequence of the plurality of MCM components is determined based on a required difference in temperature between the first MCM component and the last MCM component in the sequence of the plurality of MCM components.

8. The device of claim 1, wherein each Peltier module of the plurality of Peltier modules includes an n-doped semiconductor electrically connected with a p-doped semiconductor arranged in parallel with the n-doped semiconductor.

9. The device of claim 8, wherein the n-doped semiconductor and the p-doped semiconductor are at least one of: silicon based semiconductors or bismuth telluride based semiconductors.

10. The device of claim 1, wherein a thickness of each MCM component in the sequence of the plurality of MCM components is in a range of 0.1 centimeters (cm) to 1 cm.

11. The device of claim 1, wherein an amount of the current provided to each powered Peltier module is determined based on a number of the MCM components, and a coefficient of performance associated with the layered structure selected for the magnetic refrigeration.

12. A method for magnetic refrigeration, comprising:

forming a layered structure that includes a sequence of a plurality of magnetocaloric material (MCM) components interlinked with a sequence of a plurality of Peltier modules, wherein each Peltier module of the plurality of Peltier modules is sandwiched between two MCM components of the plurality of MCM components and transfers heat between two adjacently arranged MCM components of the plurality of MCM components, wherein a first layer in the layered structure is a first MCM component in the sequence of the plurality of MCM components and a last layer in the layered structure is a last MCM component in the sequence of the plurality of MCM components, wherein the first MCM component and the last MCM component interact with hot and cold environments to enable transfer of heat between the hot and cold environments;

concurrently powering each Peltier module in the sequence of the plurality of Peltier modules by using a power source, wherein current in each powered Peltier module flows in a constant direction; and applying spatially uniform magnetic field to the sequence of the plurality of MCM components, by using a magnetic source.

13. The method of claim 12, wherein at least the first MCM component and the last MCM component in the sequence of the plurality of MCM components possesses a porous structure.

14. The method of claim 12, further comprising coupling a cooling unit to at least the first MCM component and the last MCM component in the sequence of the plurality of MCM components, wherein the cooling unit includes at least: a pipe, a working fluid and a heat exchanger.

15. The method of claim 12, further comprising receiving, by the first MCM component or the last MCM component in the sequence of the plurality of MCM components, air for cooling via a fan.

16. The method of claim 12, wherein a second layer in the layered structure is a first Peltier module, a third layer in the layered structure is a second MCM component and a fourth layer in the layered structure is a second Peltier module, and wherein the second MCM component is sandwiched between the first Peltier module and the second Peltier module.

17. The method of claim 12, further comprising determining a number of the MCM components in the sequence of the plurality of MCM components based on a required difference in temperature between the first MCM component and the last MCM component in the sequence of the plurality of MCM components.

18. The method of claim 12, further comprising determining an amount of the current provided to each powered Peltier module based on a number of the MCM components, and a coefficient of performance associated with the layered structure selected for the magnetic refrigeration.

* * * * *